US006187455B1

(12) United States Patent
Eschauzier

(10) Patent No.: US 6,187,455 B1
(45) Date of Patent: Feb. 13, 2001

(54) DECORATIVE ROLL-PATTERNED STRIP AND PROCESS OF MAKING SAME

(75) Inventor: Frans R. Eschauzier, Zwijndrecht (NL)

(73) Assignee: Hunter Douglas International N.V., Curacao (AN)

( * ) Notice: Under 35 U.S.C. 154(b), the term of this patent shall be extended for 0 days.

(21) Appl. No.: 09/275,641

(22) Filed: Mar. 24, 1999

(30) Foreign Application Priority Data

Mar. 24, 1998 (EP) ..... 98200923

(51) Int. Cl.[7] ..... B32B 3/00; B21D 13/00

(52) U.S. Cl. ..... 428/687; 52/660; 72/199; 72/252.5; 72/366.2; 72/379.6; 72/700; 160/113; 160/166.1; 160/236; 428/156; 428/161; 428/162; 428/174; 428/179; 428/187; 428/216; 428/220; 428/335; 428/339; 428/542.6; 428/542.8; 428/577; 428/587; 428/923

(58) Field of Search ..... 428/687, 156, 428/161, 162, 174, 179, 187, 216, 220, 335, 339, 542.6, 542.8, 577, 587, 923; 72/199, 252.5, 366.2, 379.6, 700; 160/113, 166.1, 236; 52/660

(56) References Cited

U.S. PATENT DOCUMENTS

| | | | | |
|---|---|---|---|---|
| 3,956,915 | | 5/1976 | Saunders et al. | 72/199 |
| 4,362,039 | | 12/1982 | Toti | 72/186 |
| 4,499,938 | | 2/1985 | Toti | 160/236 |
| 5,215,245 | | 6/1993 | Moyer | 228/152 |
| 5,311,814 | | 5/1994 | Kierson | 160/236 |
| 5,552,235 | * | 9/1996 | Bastawros et al. | 428/687 |

FOREIGN PATENT DOCUMENTS

| | | |
|---|---|---|
| 1944295 | 4/1971 | (DE) . |
| 3117936 | 11/1982 | (DE) . |
| 676251 | 10/1995 | (EP) . |
| 2075428 | 11/1981 | (GB) . |
| WO 95/07775 | 3/1995 | (WO) . |

* cited by examiner

*Primary Examiner*—Deborah Jones
*Assistant Examiner*—Robert R. Koehler
(74) *Attorney, Agent, or Firm*—Dorsey & Whitney LLP

(57) ABSTRACT

A decorative roll-patterned metal strip or sheet, preferably aluminium strip or sheet, having: a thickness of about 0.05–1.0 mm, preferably about 0.1–0.8 mm, with a surface having a plurality of indentations of a depth of about 0.001–0.05 mm, preferably about 0.02–0.035 mm, and optionally having a layer of a paint of a thickness of about 3–30 microns, preferably about 10–15 microns, on the surface and within its indentations, the ratio of the depth of the indentations to the thickness of the strip or sheet being in the range of about 1:5 to about 1:100. A process is provided for making the decorative roll-patterned metal strip.

48 Claims, 4 Drawing Sheets

DECORATIVE ROLL-PATTERNED STRIP AND PROCESS OF MAKING SAME

BACKGROUND OF THE INVENTION a. Field of the Invention

This invention relates to a process of roll-patterning and then painting a surface of a metal strip or sheet, particularly an aluminium strip or sheet used to form vanes or head or bottom rails for window covering assemblies, such as venetian blinds, or to form architectural panels for ceilings or wall coverings. This invention particularly relates to a painted metal strip or sheet with a decorative pattern on at least one surface, made by the process, and to a window covering assemblies and architectural panels made from the strip or sheet.

b. Background Art

Elongated vanes or slats of the type used in horizontal and vertical blinds are well known and commercially available. Such slats are formed, for example, by continuous casting of aluminium strips or sheets, subsequent milling and, if necessary, cutting to width to provide coils of aluminium strips having the desired thickness and width. Subsequently, the strips or sheets are painted (optional), then roll-formed and cut into slats of the desired length. Likewise, it is well known to roll-form and cut such strips or sheets into head and bottom rails and architectural panels.

Since window coverings and architectural products are frequently decorative, different colours and laminated or painted patterns are often provided on their exterior surfaces, particularly on the visible surfaces of slats and head and bottom rails of window coverings. In this regard, coiled strip, used to make blind slats, is normally covered with paint or lacquer in a coil-coating process in order to give it a decorative pattern before it is roll-formed into slats.

A pattern can then be rolled into the painted strip surface, so that the resulting indentations in the strip surface give it a fabric-like appearance. An example of a process and apparatus for providing such a pattern in a painted strip surface for foldable metal drape panels for vertical blinds is described in U.S. Pat. No. 4,362,039 (Toti). In the process of his patent, a rotary die is used to produce continuous patterns of scribe lines in painted surfaces of strips. The scribe lines assist in subsequently forming a preselected cross-sectional profile of the metal drape panels. Another rotary die is used for subsequently forming patterns of embossments in the strips between the scribe lines, in order to begin to stretch and work the metal between the scribe lines, so as to make it easier thereafter to form a weave pattern. Two additional rotary cutting die stations then cut the male and female hinges of the drape panel, and then, a rotary weave die station produces weave patterns between the scribe lines. The weave patterns comprise relatively deep cuts which slice through the metal at the edges of the pattern and provide a raised area which imitates the ins and outs of woven threads of cloth. Unfortunately, these cuts tend to damage the paint on the strip surface and can result in premature corrosion of the metal.

U.S. Pat. No. 4,499,938 (Toti) also describes a process and apparatus for making a metal blind slat by providing a relatively deeply embossed rib pattern in a painted strip material. The depth of the pattern is described as 0.015 inch (0.381 mm) in a strip of 0.008–0.010 inch (0.20–0.254 mm) thickness. This means that the depth of the pattern is more than the thickness of the strip, and so, the strip has been corrugated. Unfortunately, such an embossed pattern also inevitably tends to damage the paint on the strip and produce premature corrosion of the metal.

BRIEF SUMMARY OF THE INVENTION

In accordance with this invention, a decorative roll-patterned metal strip or sheet, preferably an aluminium strip or sheet, is provided that has a thickness of about 0.05–1.0 mm, preferably about 0.1–0.8 mm, with a surface having a plurality of indentations of a depth of about 0.001–0.05 mm, preferably about 0.02–0.035 mm, and optionally having a layer of a paint of a thickness of about 3–30 microns, preferably about 10–15 microns, on the surface and within its indentations; the ratio of the depth of the indentations to the thickness of the strip or sheet being in the range of about 1:5 to about 1:100. Preferably, the indentations form a pattern which covers substantially the entire surface of the strip or sheet and which is visible to the naked eye, even though the paint is within and atop the indentations.

Also in accordance with this invention, a process is provided for making the decorative roll-patterned metal strip, comprising the steps of:

cold-rolling a metal strip or sheet, preferably an aluminum strip or sheet, at a temperature of about 40–175 C to reduce the thickness of the strip or sheet by about 15–40%, preferably about 20–30%, to about 0.05–1.0 mm, preferably about 0.1–0.8 mm, using a milling roll with a surface pattern thereon, to form a roll-patterned strip or sheet having, in a surface, a plurality of indentations corresponding to the surface pattern of the milling roll and with a depth of about 0.001–0.05 mm, preferably 0.02–0.035 mm; the ratio of the depth of the indentations to the thickness of the strip or sheet being in the range of about 1:5 to about 1:100; and then optionally painting the surface of the roll-patterned strip or sheet with a thickness of about 3–30 microns, preferably about 10–15 microns, of paint on the surface and within its indentations.

Preferably, the cold-rolling step using the milling roll with the surface pattern is carried out in a last stand of a multi-stand cold-roll mill, and only the last stand has at least one of its milling rolls with the surface pattern. Subsequent painting of the strip or sheet is preferably carried out in a separate machine for coil-coating.

Further in accordance with this invention are provided vanes and head and bottom rails for window covering assemblies, such as venetian blinds, and architectural panels for ceilings or wall coverings made from the decorative roll-patterned strip or sheet of the invention.

Further aspects of the invention will be apparent from the detailed description below of particular embodiments and the drawings thereof.

DESCRIPTION OF THE PREFERRED EMBODIMENTS

Figure 1:
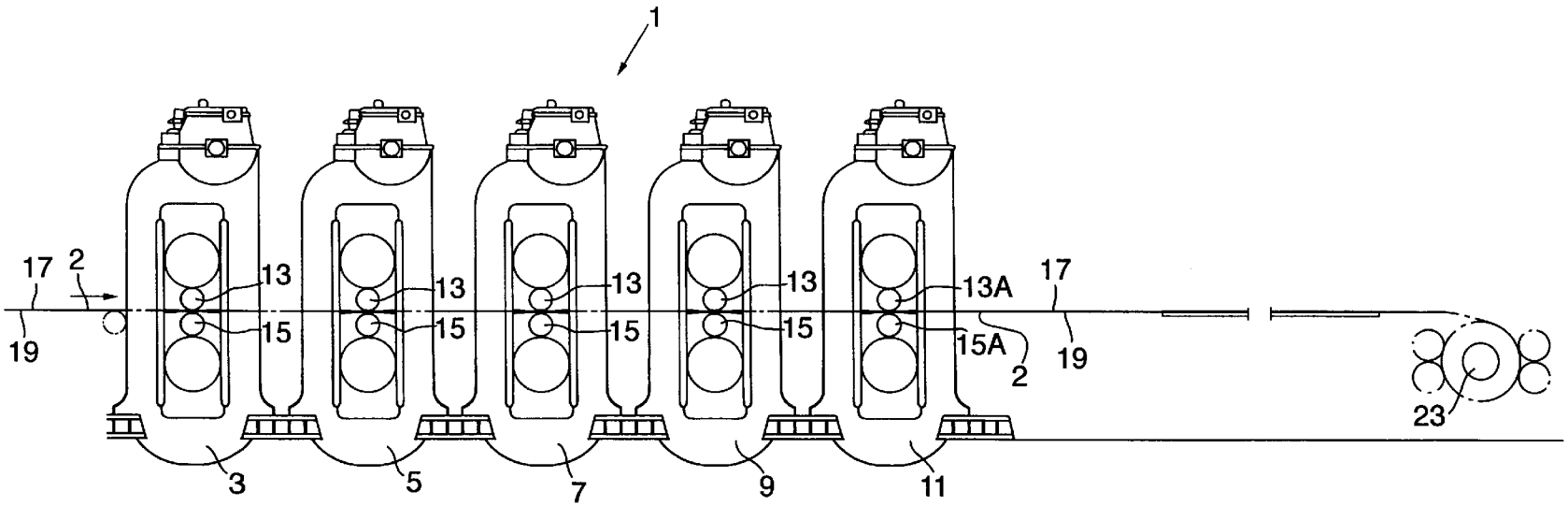
FIG. 1 shows a multi-stand cold roll mill, in which the last mill stand is a cold pattern-rolling mill stand in accordance with the invention.

FIG. 1 shows a five-stand cold roll reducing mill 1 for milling and roll-patterning a strip or sheet, such as an aluminium strip 2, in accordance with this invention. The strip 2 enters the mill 1 still in a ductile state following conventional heating and quenching steps. The five stands 3, 5, 7, 9 and 11 of the mill 1 sequentially reduce the thickness of the aluminium strip 2 in a conventional manner by simultaneously pressing with opposed top and bottom, steel, milling or working rolls, generally 13 and 15, on the top and bottom surfaces 17 and 19 of the strip 2. However, the last stand 11 has one or both of its top and bottom, milling rolls 13A and 15A with patterned surfaces in contact with the strip 2 to provide roll-patterned indentations 21 in one or both of the adjacent surfaces 17 and 19 of the strip 2. During the cold rolling steps in stands 3–11, the temperature of the strip 2 is generally 40–175 C, preferably 75–120 C.

The thickness of the strip 2 is preferably reduced in the last stand 11 by 15–40 %, preferably 20–30%, to a thickness of 0.05–1.0 mm, preferably 0.1–0.8 mm., especially 0.1–0.3 mm for making slats and 0.4–0.7 for making head or bottom rails. At the same time, the top surface 17, the bottom surface 19 or both of the strip 2 are roll-patterned by the patterned surface of the adjacent top and/or bottom, milling rolls 13A and 15A of the last stand 11 as shown in FIGS. 3A–3C.

Preferably, the strip 2 is still in a ductile state when it reaches the last cold roll stand 11 so that it is easier to roll-pattern the surface of the strip to provide a plurality of indentations 21 therein to a depth of 0.001–0.05 mm, preferably 0.02–0.035 mm, with the ratio of the depth of the indentations 21 to the thickness of the strip 2 being in the range of 1:5 to 1:100. By the term "depth of indentations" is meant the depth of the indentations 21 in the strip 2 relative to the mean thickness of the strip 2 after roll-pressing in accordance with this invention. Preferably, the ratio of the depth of the indentations 21 to the thickness of the roll-patterned strip 2 is no more than 1:10, particularly no more than 1:16, and no less than 1:50, particularly no less than 1 40. The roll-patterning of this invention does not corrugate the strip 2 but takes place only on its surface, so that the so-formed indentations 21 are accommodated entirely within the thickness of the strip.

Figure 3A:
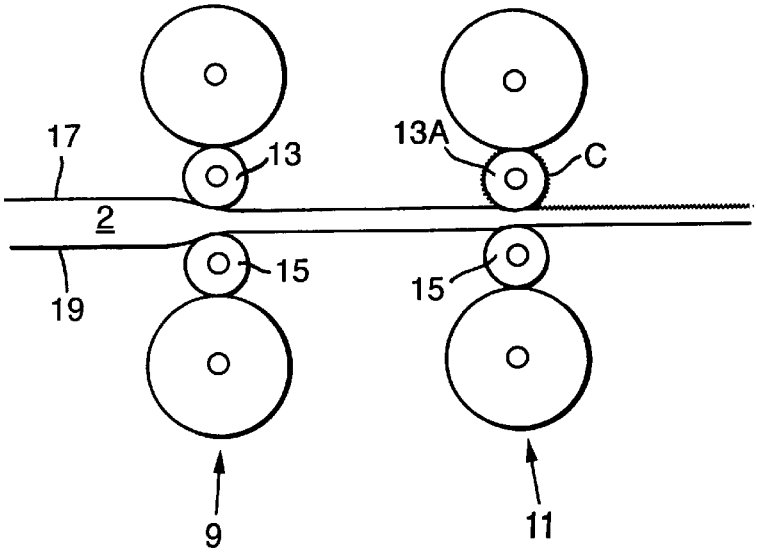
FIGS. 3A–3C are schematic views of the last two stands of the rolling mill of FIG. 1, showing the use of different patterning roll(s) at the last mill stand.
Figure 3B:
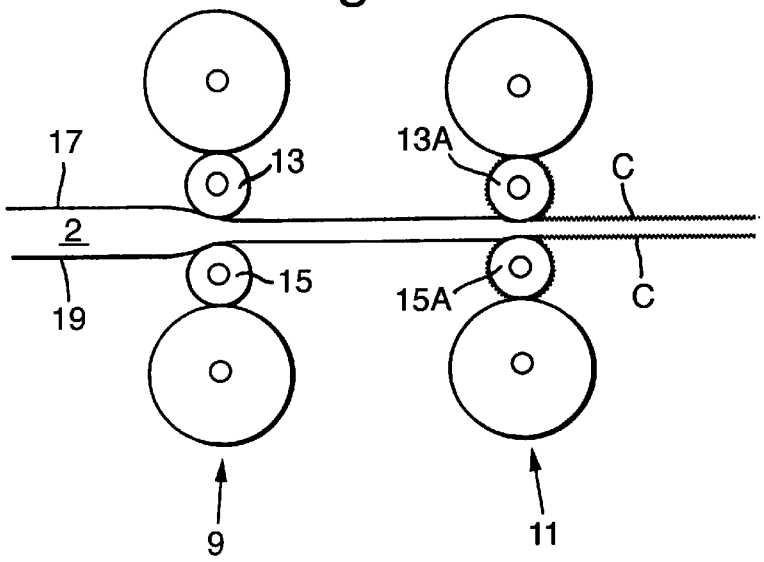
Figure 3C:
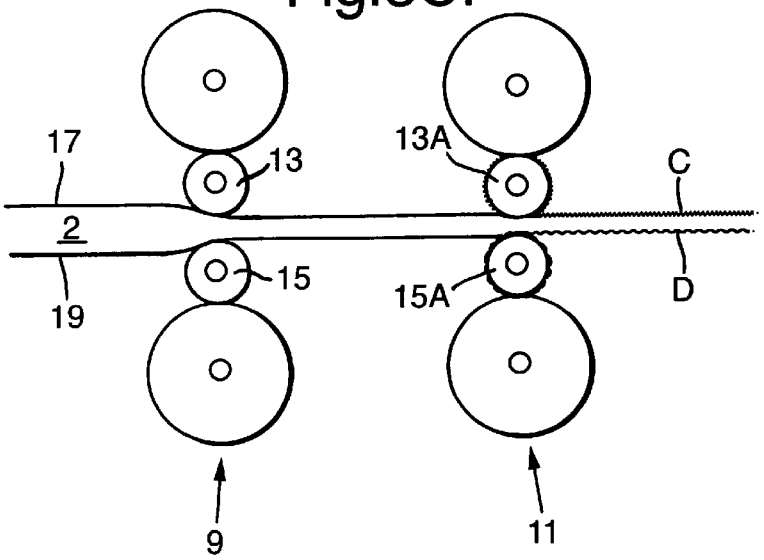

In accordance with the invention, a pattern C on the surface of either the top or bottom, milling roll 13A or 15A of the last stand 11 can be rolled only into the adjacent top or bottom surface 17 or 19 of the strip 2 (FIG. 3A). This is often preferred for a strip 2 that is later to be roll-formed in a conventional manner into head or bottom rails for window covering assemblies or into architectural panels. Likewise, a pattern C on the surface of both the top and bottom, milling rolls 13A and 15A of the last stand 11 can be rolled simultaneously into both the adjacent top and bottom surfaces 17 and 19 of the strip 2 (FIG. 3B). This is often preferred for a strip 2 that is later to be roll-formed into horizontal or vertical slats for window covering assemblies which have both sides visible in use. Similarly, a pattern C on the surface of top milling roll 13A of the last stand 11 can be rolled into the adjacent top surface 17 of the strip 2, and a different pattern D on the surface of the bottom milling roll 15A of the last stand 11 can simultaneously be rolled into the adjacent bottom surface 19 of the strip 2 (FIG. 3C).

Figure 2:
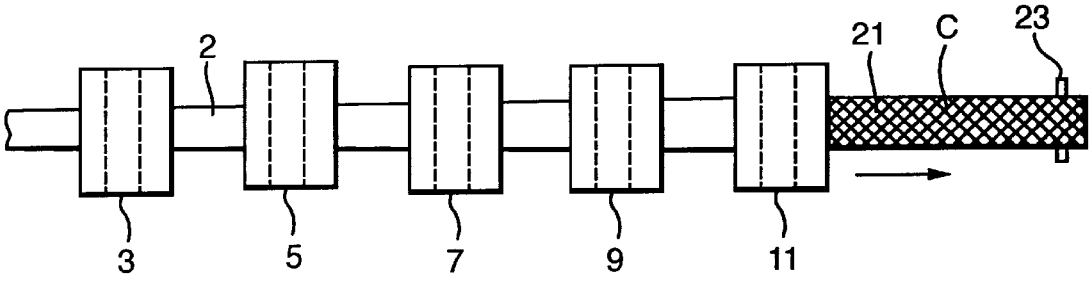
FIG. 2 is a schematic top view of the rolling mill of FIG. 1, showing the roll-patterned strip leaving the last mill stand.

FIG. 2 shows the five-stand cold roll reducing mill 1 from above. The strip 2 enters at stand 3 and is milled through stands 3–11. The last stand 11 is the cold mill stand with one or two patterned milling rolls 13A and/or 15A. Strip 2 exits stand 11 with pattern C from the patterned rolls on its surface and is then led to roll-up stand 23.

FIG. 3A shows cold mill stand 9 and its pair of conventional milling rolls 13 and 15 and cold mill stand 11 and its pair of a top milling roll 13A with pattern C on its surface and a conventional bottom milling roll 15. The thickness of strip 2 is reduced in stand 11, and it exits stand 11 with the pattern C on its top surface 17.

Likewise, FIG. 3B shows cold mill stand 9 and its pair of conventional milling rolls 13 and 15 and cold mill stand 11 and its pair of a top milling roll 13A and bottom milling roll 15A, both with pattern C on their surfaces. The thickness of strip 2 is reduced in stand 11, and it exits stand 11 with the pattern C on its top and bottom surfaces 17 and 19.

Likewise, FIG. 3C shows cold mill stand 9 and its pair of conventional milling rolls 13 and 15 and cold mill stand 11 and its pair of a top milling roll 13A with pattern C on its surface and a bottom milling roll 15A with pattern D on its surface. The thickness of strip 2 is reduced in stand 11, and it exits stand 11 with the pattern C on its top surface 17 and the pattern D on its bottom surface 19.

Figure 4:
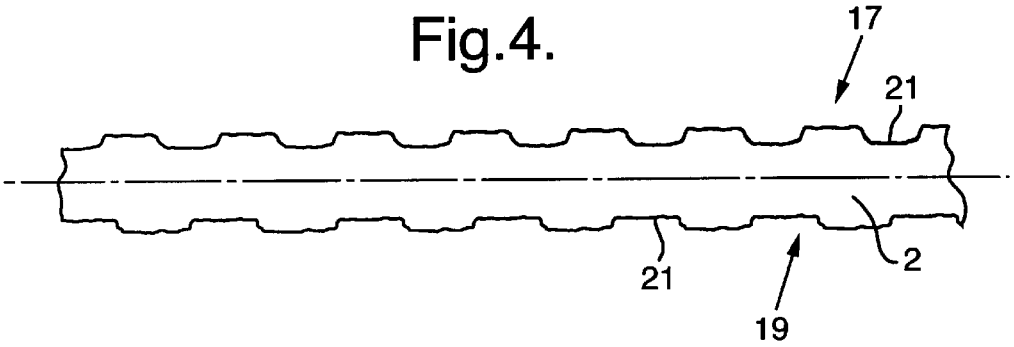
FIG. 4 is a schematic cross-section of a strip of the invention, which is roll-patterned on both sides.

FIG. 4 is a cross-section of a roll-patterned strip 2 of this invention as made, for example, in the mill stand 11 of FIG. 3C. FIG. 4 shows that the cold roll-patterning process, carried out in mill stand 11, does not corrugate the strip 2. Strip 2, has pattern C on the top surface 17 and a different pattern D on the bottom surface 19. The depth of the indentations 21 of each roll-pattern C and D is between 0.001 and 0.05 mm and preferably between 0.02 and 0.035 mm. As a result, each surface 17 and 19 can be painted, using conventional coating rollers and heat-curing techniques of coil-coating processes, without losing the appearance of its roll-pattern C or D.

Figure 5A:
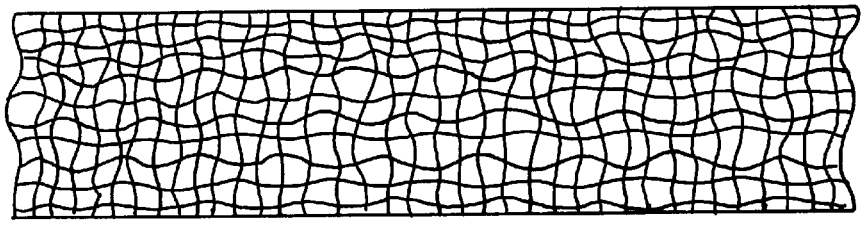
FIGS. 5A–5E show different examples of roll-patterns of the invention.
Figure 5B:
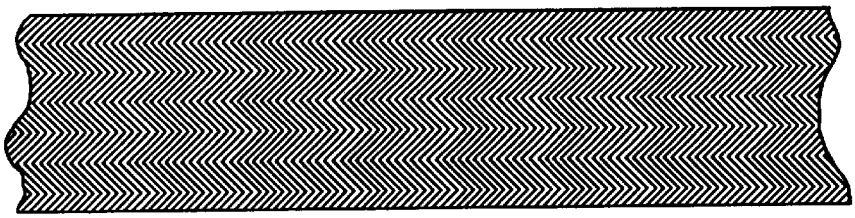
Figure 5C:
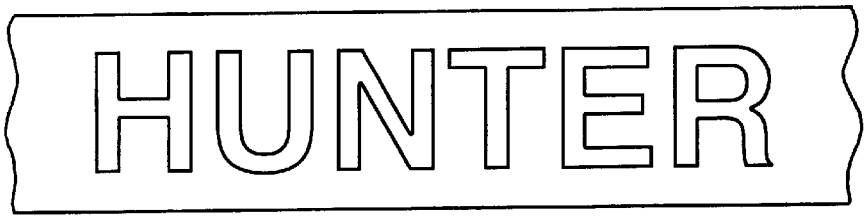
Figure 5D:
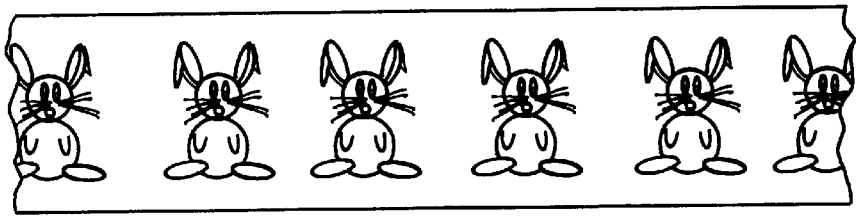
Figure 5E:
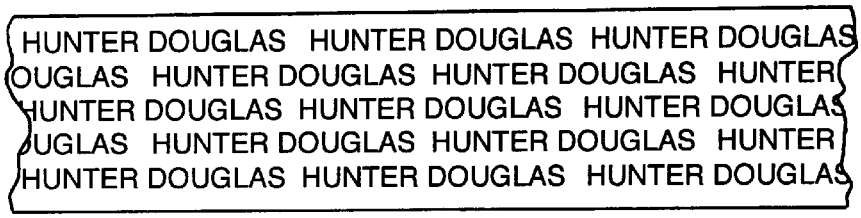

FIGS. 5A–5E show examples of some of the different roll-patterns that can be provided on the surface(s) of strip 2. In fact, there is an endless variety of possible patterns. Changing the pattern simply entails putting in a differently patterned milling roll 13A or 15A in the last stand 11 of the cold rolling multi-stand mill 1. FIG. 5A shows a lattice-like pattern. FIG. 5B shows a fish-grate wavy like pattern. FIGS. 5C and 5E show lettering patterns. FIG. 5D shows a figurine-like pattern.

After roll-patterning, the strip 2 can be rolled up in a conventional manner on roll 23 and allowed to cool. The roll-patterned surface(s) 17 and or 19 of the strip 2 can then be painted in a conventional manner with a thickness of 3–30 microns, preferably 10–15 microns, of paint on the surface(s) and within the indentations 21. In this regard, each roll-patterned surface 17 and/or 19 of the strip 2 can be passed over a conventional paint applicator roller as described in the patent publications: EP 0 070 705 and U.S. Pat. No. 3,068,119.

Finally, the painted strip 2 can be roll-formed in a conventional manner to form elongated horizontal or vertical slats or head or bottom rails for window covering assemblies, such as venetian blinds, or to form architectural panels for ceilings or wall coverings. In this regard, the painted and roll-patterned strip 2 can be passed between conventional forming rolls as described in the patent publications: U.S. Pat. No. 4,173,879, U.S. 4,145,905, U.S. 326,724, U.S. 2,692,003, U.S. 2,518,846, U.S. 2,471,490, U.S. 2,346,990 and U.S. 2,313,111.

This invention is, of course, not limited to the above-described embodiments which may be modified without departing from the scope of the invention or sacrificing all of its advantages. In this regard, the terms in the foregoing description and the following claims, such as "horizontal", "vertical", "top" and "bottom", have been used only as relative terms to describe the relationships of the various elements of the cold roll reducing mill 1 of the invention.

I claim:

1. A decorative roll-patterned metal strip having a thickness of about 0.05–1.0 mm and a surface having a plurality of indentations of a depth of about 0.001–0.05 mm, wherein the ratio of the depth of the indentations to the thickness of the strip is in the range of about 1:5 to about 1:100.

2. A decorative roll-patterned metal strip according to claim 1, wherein said strip is made from aluminium, and wherein said thickness of said strip is about 0.1–0.8 mm, and said depth of said plurality of indentations is about 0.02–0.035 mm.

3. A decorative roll-patterned metal strip according to claim 1 or 2, wherein said strip has a layer of a paint of a thickness of about 3–30 microns on the surface and within said indentations.

4. The strip of claim 3 wherein the indentations form a pattern which covers substantially the entire surface of the strip and which is visible to the naked eye.

5. A decorative roll-patterned metal strip according to claim 1 or 3, wherein said thickness of said layer of said paint is about 10–15 microns.

6. The strip of claim 5 wherein the indentations form a pattern which covers substantially the entire surface of the strip and which is visible to the naked eye.

7. A vane for a window covering assembly, made from the roll-patterned strip of any one of claims 1 or 2.

8. A head rail or bottom rail for a window covering assembly, made from the roll-patterned strip of any one of claims 1 on 2.

9. An architectural panel for a ceiling or wall covering, made from the roll-patterned strip of any one of claims 1 or 2.

10. A vane for a window covering assembly, made from the roll-patterned strip of claim 3.

11. A vane for a window covering assembly, made from the roll-patterned strip of claim 5.

12. A vane for a window covering assembly, made from the roll-patterned strip of claim 4.

13. A vane for a window covering assembly, made from the roll-patterned strip of claim 6.

14. A head rail or bottom rail for a window covering assembly, made from the roll-patterned strip of claim 3.

15. A head rail or bottom rail for a window covering assembly, made from the roll-patterned strip of claim 5.

16. A head rail or bottom rail for a window covering assembly, made from the roll-patterned strip of claim 4.

17. A head rail or bottom rail for a window covering assembly, made from the roll-patterned strip of claim 6.

18. An architectural panel for a ceiling or wall covering, made from the roll-patterned strip of claim 3.

19. An architectural panel for a ceiling or wall covering, made from the roll-patterned strip of claim 5.

20. An architectural panel for a ceiling or wall covering, made from the roll-patterned strip of claim 4.

21. An architectural panel for a ceiling or wall covering, made from the roll-patterned strip of claim 6.

22. A process for making a decorative roll-patterned metal strip having a thickness of about 0.05–1.0 mm with a surface having a plurality of indentations of a depth of about 0.001–0.05 mm. wherein the ratio of the depth of the indentations to the thickness of the strip is in the range of about 1:5 to about 1:100, said process comprising the steps of:

cold-rolling a metal strip at a temperature of about 40–175 C to reduce the thickness of the strip by about 15–40% to about 0.05–1.0 mm, using a milling roll with a surface pattern thereon, to form a roll-patterned strip having, in a surface, a plurality of indentations corresponding to the surface pattern of the milling roll, said indentations having a depth of about 0.001–0.05 mm, wherein a ratio of the depth of the indentations to the thickness of the strip is in the range of about 1:5 to about 1:100.

23. A process for making a decorative roll-patterned aluminium strip having a thickness of about 0.1–0.8 mm with a surface having a plurality of indentations of a depth of about 0.02–0.035 mm, wherein the ratio of the depth of the indentations to the thickness of the strip is in the range of about 1:5 to about 1:100, said process comprising the steps of:

cold-rolling an aluminium strip at a temperature of about 40–175 C to reduce the thickness of the strip by about 20–30%, to about 0.1–0.8 mm, using a milling roll with a surface pattern thereon, to form a roll-patterned strip having, in a surface, a plurality of indentations corresponding to the surface pattern of the milling roll and with a depth of about 0.02–0.035 mm, wherein a ratio of the depth of the indentations to the thickness of the strip is in the range of about 1:5 to about 1:100.

24. The process of claim 22 or 23 wherein the cold-rolling step using the milling roll with the surface pattern is carried out in a last stand of a multi-stand cold-roll mill, and only the last stand has at least one of its milling rolls with the surface pattern.

25. The process of claim 24 wherein the strip is in a ductile state in the last stand.

26. The process of claim 25 wherein the temperature of the strip in the last stand is about 75–120 C.

27. The process of claim 22 or 23 wherein the pattern is rolled on only one surface of the strip.

28. The process of claim 22 or 23 wherein the pattern is rolled on both surfaces of the strip.

29. The process of claim 22 or 23 wherein the ratio of the depth of the indentations to the thickness of the roll-patterned strip is no more than about 1:10.

30. The process of claim 22 or 23 wherein the ratio of the depth of the indentations to the thickness of the roll-patterned strip is at least about 1:50.

31. The process of claim 22 or 23 further comprising the step of painting the surface of the roll-patterned strip with a thickness of about 3–30 microns of paint on the surface and within its indentations.

32. The process of claim 31, wherein said painting step further comprises painting the surface of the roll-patterned strip with a thickness of about 10–15 microns.

33. The process of claim 31 wherein the cold-rolling step using th e milling roll with the surface pattern is carried out in a last stand of a multi-stand cold-roll mill, and only the last stand has at least one of its milling rolls with the surface pattern.

34. The process of claim 32 wherein the cold-rolling, step using, the milling roll with the surface pattern is carried out in a last stand of a multi-stand cold-roll mill, and only the last stand has at least one of its milling, rolls with the surface pattern.

35. The process of claim 31 wherein the pattern is rolled on only one surface of the strip.

36. The process of claim 32 wherein the pattern is rolled on only one surface of the strip.

37. The process of claim 31 wherein the pattern is rolled on both surfaces of the strip.

38. The process of claim 32 wherein the pattern is rolled on both surfaces of the strip.

39. The process of claim 31 wherein the ratio of the depth of the indentations to the thickness of the roll-patterned strip is no more than about 1:10.

40. The process of claim 32 wherein the ratio of the depth of the indentations to the thickness of the roll-patterned strip is no more than about 1:10.

41. The process of claim 29 wherein the ratio of the depth of the indentations to the thickness of the roll-patterned strip is no more than about 1:16.

42. The process of claim 31 wherein the ratio of the depth of the indentations to the thickness of the roll-patterned strip is no more than about 1:16.

43. The process of claim 32 wherein the ratio of the depth of the indentations to the thickness of the roll-patterned strip is no more than about 1:16.

44. The process of claim 31 wherein the ratio of the depth of the indentations to the thickness of the roll-patterned strip is at least about 1:50.

45. The process of claim 32 wherein the ratio of the depth of the indentations to the thickness of the roll-patterned strip is at least about 1:50.

46. The process of claim 30 wherein the ratio of the depth of the indentations to the thickness of the roll-patterned strip is at least about 1:40.

47. The process of claim 31 wherein the ratio of the depth of the indentations to the thickness of the roll-patterned strip is at least about 1:40.

48. The process of claim 32 wherein the ratio of the depth of the indentations to the thickness of the roll-patterned strip is at least about 1:40.

* * * * *